US010332381B2

(12) United States Patent
Suryan et al.

(10) Patent No.: US 10,332,381 B2
(45) Date of Patent: Jun. 25, 2019

(54) INTELLIGENT ASSET DETACHMENT SENSOR SYSTEM

(71) Applicant: Tether Technologies, Inc., Seattle, WA (US)

(72) Inventors: John D. Suryan, Bellevue, WA (US); Edgar R. Neely, Vashon, WA (US)

(73) Assignee: Tech Traks, Inc., Bellevue, WA (US)

( * ) Notice: Subject to any disclaimer, the term of this patent is extended or adjusted under 35 U.S.C. 154(b) by 0 days.

(21) Appl. No.: 15/480,236

(22) Filed: Apr. 5, 2017

(65) Prior Publication Data

US 2017/0287311 A1 Oct. 5, 2017

Related U.S. Application Data

(60) Provisional application No. 62/318,722, filed on Apr. 5, 2016.

(51) Int. Cl.

| | |
|---|---|
| ***G08B 21/24*** | (2006.01) |
| ***A45F 5/00*** | (2006.01) |
| ***G08B 3/10*** | (2006.01) |
| ***A45C 13/24*** | (2006.01) |
| ***G08B 25/01*** | (2006.01) |

(52) U.S. Cl.

CPC ..... *G08B 21/24* (2013.01); *A45C 13/24* (2013.01); *A45F 5/00* (2013.01); *G08B 3/10* (2013.01);

(Continued)

(58) Field of Classification Search

CPC ..... G08B 21/21; G08B 3/10; G08B 25/016; A45C 13/24

(Continued)

(56) References Cited

U.S. PATENT DOCUMENTS

2004/0021573 A1* 2/2004 Hoffman ..... G08B 21/023 340/573.1
2007/0296545 A1* 12/2007 Clare ..... G08B 13/14 340/5.64

(Continued)

FOREIGN PATENT DOCUMENTS

| | | |
|---|---|---|
| DE | 3217888 | 11/1983 |
| EP | 0283495 | 4/1988 |

(Continued)

OTHER PUBLICATIONS

International Searching Authority, "International Search Report and the Written Opinion for PCT/US2017/026209", "Foreign Counterpart to U.S. Appl. No. 15/480,236", dated Jul. 21, 2017, pp. 1-15, Published in: WO.

(Continued)

*Primary Examiner* — Jack K Wang
(74) *Attorney, Agent, or Firm* — Fogg & Powers LLC

(57) ABSTRACT

An embodiment of an intelligent personal device detachment sensor apparatus and system for a lanyard, belt clip, pocket clip, or other worn device for displaying a security device, such as an identification and/or card or badge on an individual user. The device is particularly useful for monitoring the presence of the card, badge or other small asset, with many of such assets employed at security, environmental clearance, and access checkpoints. The apparatus consists of two parts, a user holder and an asset holder, held to one another in a "docked" condition using a permanent magnet of the asset holder attachable to a permanent magnet on the user holder. The user holder has a switch (e.g., a mechanical switch), an alarm device to produce an audible signal to the user, and a transmitter that transmits an alert through a network.

26 Claims, 13 Drawing Sheets

(52) U.S. Cl.
CPC ..... *G08B 25/016* (2013.01); *A45F 2005/006* (2013.01); *A45F 2200/055* (2013.01)

(58) Field of Classification Search
USPC ..... 340/568.4
See application file for complete search history.

(56) References Cited

U.S. PATENT DOCUMENTS

| | | | | |
|---|---|---|---|---|
| 2012/0229975 | A1* | 9/2012 | Yang | B65D 63/14 361/679.57 |
| 2013/0306738 | A1* | 11/2013 | Peterson | H05B 37/0227 235/492 |
| 2014/0035754 | A1* | 2/2014 | Thielman | G08B 21/24 340/686.6 |
| 2014/0159840 | A1* | 6/2014 | Qadri | H04B 1/3888 335/285 |

FOREIGN PATENT DOCUMENTS

| | | |
|---|---|---|
| FR | 2634040 | 1/1990 |
| GB | 2436718 | 10/2007 |

OTHER PUBLICATIONS

International Bureau, "International Preliminary Report on Patentability from PCT/US2017/026209 dated Oct. 18, 2018", "from Foreign Counterpart of U.S. Appl. No. 15/480,236", Oct. 18, 2018, p. 1-9, Published in: WO.

* cited by examiner

INTELLIGENT ASSET DETACHMENT SENSOR SYSTEM

TECHNICAL FIELD

An embodiment relates to electronic devices, and more particularly to an intelligent sensor apparatus or system that is configured to inform a user, or other person, when an item or asset (e.g., a workplace identification-and-access badge) normally attached to the user is detached from the user for longer than a threshold period of time.

SUMMARY

An embodiment of an intelligent sensor system includes a user holder and an asset holder. The user holder is configured for attachment to a user (typically a person), for example, with a lanyard, belt clip, or pocket clip, and the asset holder is configured to hold an item or asset, for example, an identification badge, an access badge, an identification-and-access badge, or key (hereinafter, "badge" refers to any of the aforementioned badges). The user holder and asset holder are configured to attach to one another in normal operation while the user goes about his/her routine. In response to the user detaching the asset holder from the user holder to use the asset (e.g., to swipe a badge past a badge reader that gives the user access to a secure area of a building), at least one of the user holder and the asset holder measures the time elapsed from the detachment, and sounds an alarm (e.g., a beep) in response to the elapsed time exceeding a time threshold (e.g., ten seconds). The purpose of the alarm is to notify the user of the prolonged detachment, which can occur, for example, if the user leaves the asset behind, if another person detaches the asset holder from the user holder without the user's knowledge, or if the asset holder detaches from the user holder sua sponte without the user's knowledge.

Furthermore, at least one of the user holder and the asset holder can be configured to notify an entity other than the user of the prolonged detachment of the asset holder from the user holder. For example, wherein the asset is a badge, then at least one of the user holder and/or the asset holder can notify a security-monitoring service of the prolonged detachment so that the service can disable the badge's ability to grant access to a secure area.

Moreover, the user holder can include a "panic button" that a user can press, or otherwise activate, to obtain assistance, for example, if the user injures himself/herself or finds himself/herself in a dangerous situation. In response to activating the panic button, the user holder can generate an audible alarm, or can transmit an alarm signal or distress call to, e.g., local police or to a security-monitoring service.

BACKGROUND

An identification (ID), or an access card or badge, is a common asset, often worn by a user to identify the user, to monitor the user, or to gain user access to a secure area. ID and electronic access badges vary in shape, size, engineered features, and construction, depending upon their intended purposes. Typical features of ID badges and access cards include a photo of the user, the user's name, and a machine-readable identification code, which may include a radio-frequency identification (RFID) tag or a similarly acting element.

Devices for attaching and securing an asset, such as an ID and access card or badge, to an individual often include, or otherwise make use of, lanyards with clip-on holders, and are well known. Typically, these devices either permanently attach to the asset, or allow the asset to disconnect from the holder by employing clips, snaps, or other metal or plastic fasteners. Other such devices employ a spring-loaded or coiled attachment cable, which allows a user to pull the asset a short distance from the user without actually detaching the asset from the device, and which then retracts or recoils to return the asset to the user.

Many of these wearable asset-attachment devices require some degree of dexterity to attach to the asset, and do not allow for the asset to be easily disconnected from the holder, as may be desired for ease of use. Furthermore, many of these devices are purely mechanical attachments, and provide no capability to alert the user, and potentially another person (e.g., a security administrator) or entity (e.g., a security-monitoring service), if the asset is misplaced, stolen or otherwise detached from the holder for a prolonged period of time.

Therefore, a need has arisen for a better attachment system for assets such as ID and access cards or badges, with easy-to-use, yet intelligent, attachment and monitoring features for both the wearer/user and the administrator of the badge or badge system.

One or more embodiments address this problem to provide a versatile, practical, and intelligent badge or other small-asset detachment-sensor system. With the following disclosure, one or more embodiments of the system are described with reference to the following detailed description, taken in conjunction with the accompanying drawings.

Figure 1:
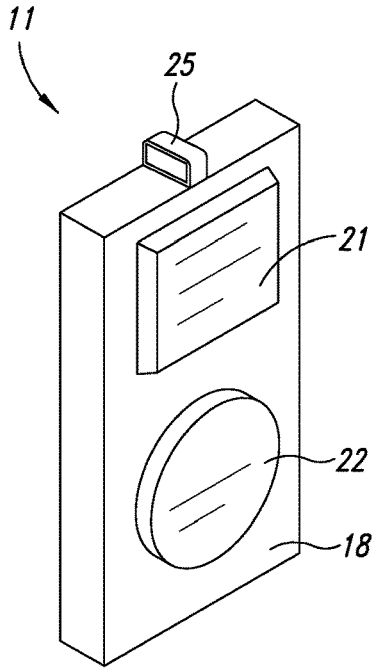
FIG. 1 is a perspective frontward view of a user holder of an asset-detachment sensor apparatus and system, according to an embodiment.

Reference characters included in the above drawings indicate corresponding parts throughout the several views, as discussed herein. The description herein illustrates one or more embodiments, in one form, and the description herein is not to be construed as limiting the scope of the disclosure or claims in any manner. It should be understood that the above-listed figures are not necessarily drawn to scale and may include fragmentary views, graphic symbols, diagrammatic representations, or schematic representations. Details that are not necessary for an understanding of embodiments by one skilled in the technology of the disclosed embodiments, or that render other details difficult to perceive, may be omitted.

DETAILED DESCRIPTION

An embodiment is an asset-detachment sensor apparatus and system, which is useful to attach an asset, such as an identification (ID) or access card or badge, or other common item or device; the asset-detachment system can be attached to a lanyard, clothing or belt clip, or other type of holder. Where the asset is a badge, the badge may vary in shape, size, engineered features and construction, as dependent upon its intended purpose. Usual features of ID and access badges include a photo of the user, and the user or wearer's name. Additionally, ID and access badges may be 'smart' and include alternative identification capabilities, such as machine-readable or electronic identification codes, and may include, or include features similar to, radio-frequency-identification (RFID) elements or tags, or other passive or active transponders.

The asset-detachment sensor system, according to an embodiment, is versatile and intuitive to use. FIGS. 1 through 7 show embodiments of an asset-detachment sensor system, also referred to herein as a personal-device detachment sensor apparatus and system 10.

Figure 4:
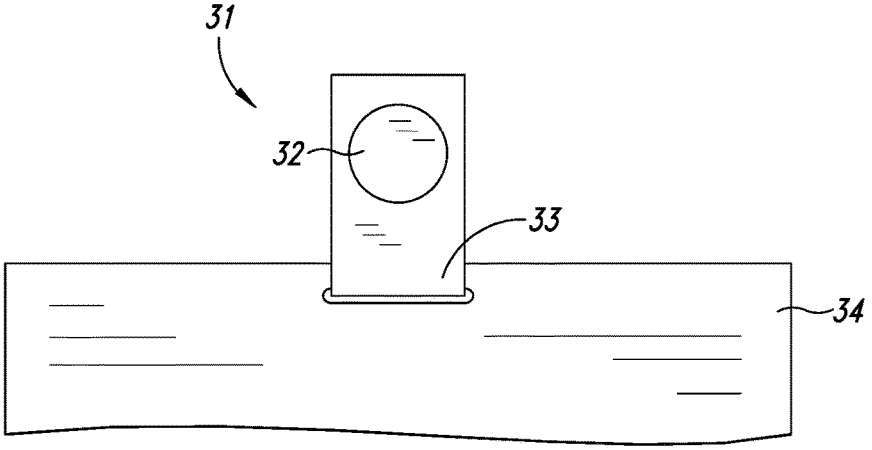
FIG. 4 is a front view of the asset-detachment sensor apparatus and system, according to an embodiment.
Figure 5:
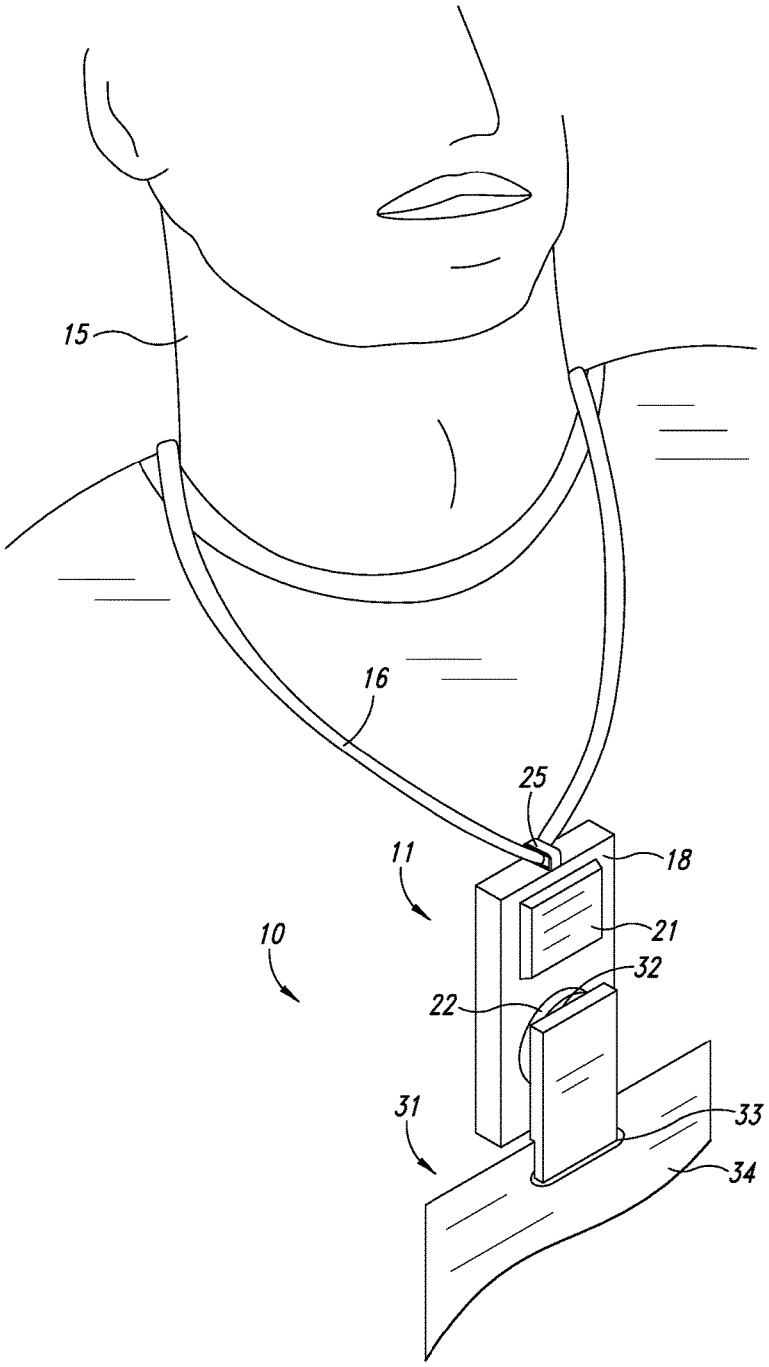
FIG. 5 is a perspective frontward view of an asset holder attached to a user holder of the asset-detachment sensor apparatus and system, according to an embodiment.

As shown in FIG. 5, the personal-device detachment sensor apparatus and system' 10 includes two parts, a user holder 11 and an asset holder 31. The user holder is configured for attaching to a user 15, as shown in FIG. 5, with, for example, a lanyard 16 or some similarly functioning device for attachment to the user. The lanyard 16 is a conventional tool for holding an asset, which is threaded-through, clipped, snapped, gripped, or in some other way, attached to the lanyard. Generally, the lanyard 16 may be any flexible ribbon, rope, string, or cable, adapted to hold a small asset. The user holder 11 includes a user attachment 25, which may be a thread-though tab for receiving the lanyard 16, or an attachment for receiving a clip type of attachment, or some similarly functioning attachment mechanism or device. Additionally, the asset holder 31 includes an asset attachment 33, which is, for example, a clip attachment (see FIG. 3) that receives an asset 34. The asset 34 is, for example, an identification (ID) or access device, such as a card, badge or key, as shown in FIGS. 3-5.

Alternatively, the asset 34 may be any security device, key-card, access-clearance device, or environmental-clearance device, for example, a badge used for personnel identification, access, or entry. Again, keys or key-cards are also considered as examples of a possible asset 34, held in the asset holder 31 of the personal-device detachment sensor apparatus and system 10.

Figure 2:
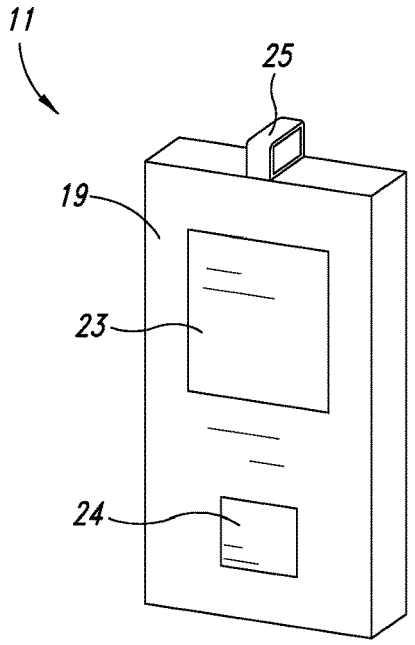
FIG. 2 is a perspective rearward view of the user holder of FIG. 1, according to an embodiment.
Figure 3:
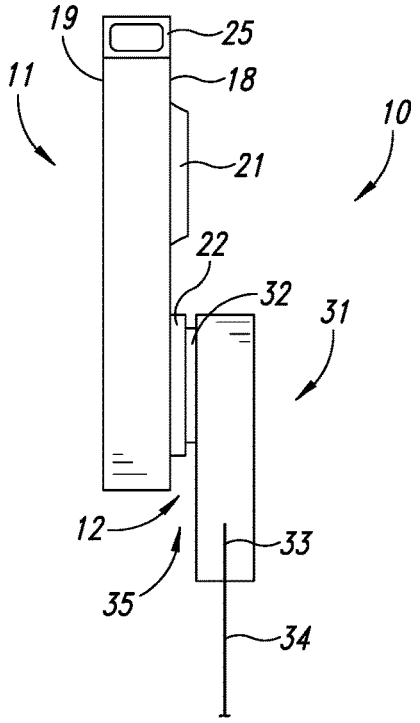
FIG. 3 is side view of an asset holder of the asset-detachment sensor apparatus and system attached to the user holder of FIGS. 1-2, according to an embodiment.

The user holder 11 and the asset holder 31 of the personal-device detachment sensor apparatus and system 10 are held together in an attached position 12, as shown in FIGS. 3 and 5. As shown in FIG. 1, the user holder 11 contains a magnet dock 22, which includes a non-magnetic material (e.g., a metal such as steel) that is magnetically attracted to a magnet, such as a permanent magnet. Behind the magnet dock 22 is a magnetic-field sensor 24, as shown in FIG. 2. The magnetic-field sensor 24 is, for example, a Hall-type integrated-circuit sensor switch, which is a magnetically activated switch, well known to those skilled in magnetic-switch technologies. The Hall switch can operate omni-polar, with both magnetic S-poles and N-poles, to detect the close proximity of magnets upon attachment.

The asset holder 31 has an asset magnet 32, as shown in FIGS. 3-4, which is a permanent magnet that attaches and docks to the magnet dock 22 of the user holder 11, as shown in FIG. 3. This magnetic connection is sensed by the magnetic-field sensor 24 to achieve an asset docked 50 functional condition for the personal-device detachment sensor apparatus and system 10, as a programmed output of an electronic control 23, with the functional operation steps of the electronic control shown schematically in FIG. 7.

Figure 6:
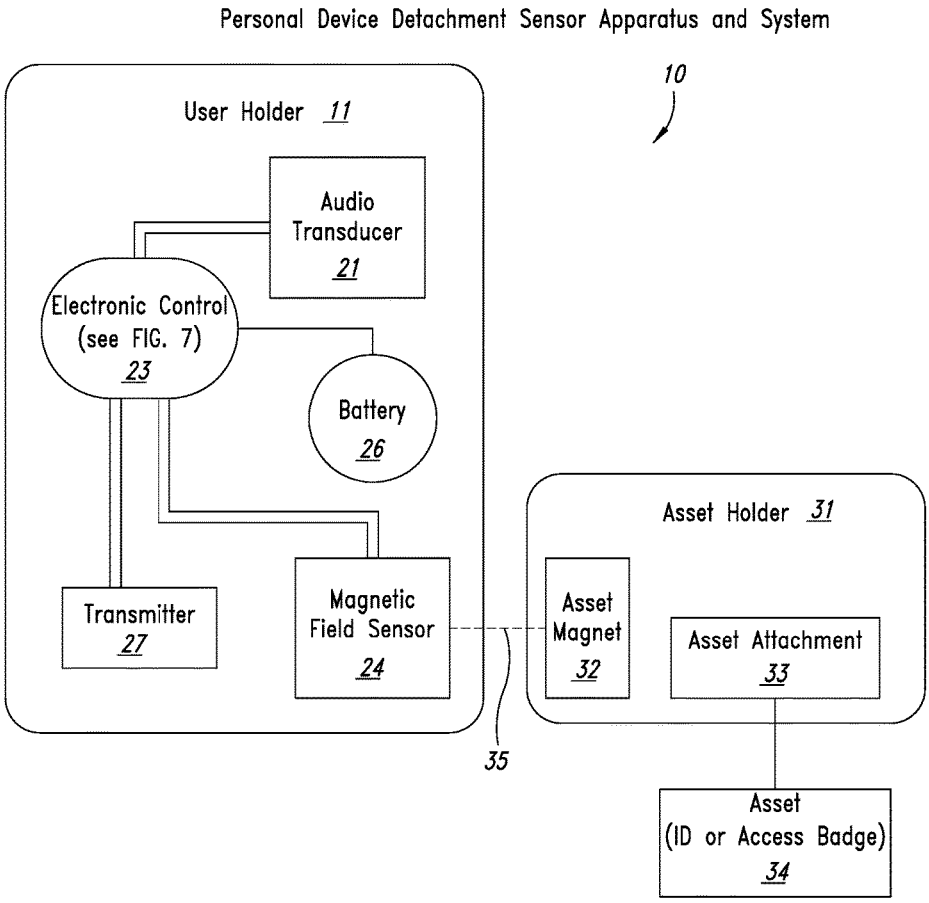
FIG. 6 is a schematic view of electronic circuitry and other electronic components of the asset-detachment sensor apparatus and system, according to an embodiment.

The user holder 11 also includes an alarm device to produce an audible signal to the user 15, with the alarm device, for example, embodied by an audio transducer 21 as shown in FIGS. 1 and 6, which may be a piezoelectric type of beeper, or any other electronic buzzer or beeper device. The audio transducer 21 is activated by the intelligent electronic control 23, which is configured to monitor the magnetic-field sensor 24 and to drive the audio transducer 21.

In an operational embodiment of the personal-device detachment sensor apparatus and system 10, the asset holder 31 attaches to the user holder 11 in a magnet-to-magnet connection 35 for easy docking, and subsequently the asset holder easily detaches to break the magnetic connection between the magnetic dock 22 of the user holder and the asset magnet 32 of the asset holder. The magnetic connection supplies sufficient force in the attached position 12 to hold the asset holder 31 in place under normal circumstances, but allows the user 15 to disconnect the asset holder simply by pulling upon the asset holder with sufficient force to detach the asset holder from the user holder 11. Then, the user 15 may securely reattach the asset holder 31 to the user holder 11, simply by placing the asset magnet into the magnet dock. Additionally, the electronic control 23 monitors this connection with the magnetic-field sensor 24 and notifies the user with the audio transducer 21 to provide an audible warning signal directed to the user, when the asset holder is removed from the user holder.

Figure 7:
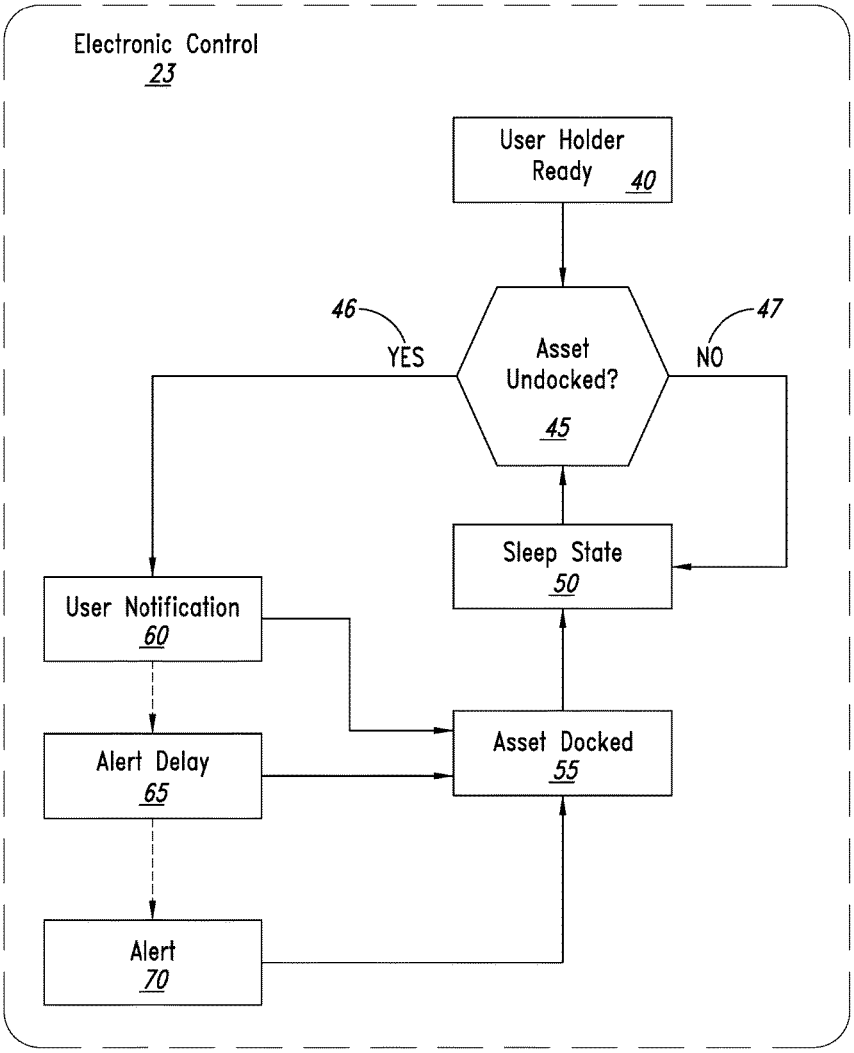
FIG. 7 is a flow diagram of the operation of the asset-detachment sensor apparatus and system, according to an embodiment.

FIG. 7 schematically details an embodiment of the functional operation of the electronic control 23 in the personal-device detachment sensor apparatus and system 10, with the user holder ready 40 function, which is completed with the battery 26 in place to energize the electrical components of the user holder 11. For example, the battery is a conventional replaceable, long life disc-type of battery, but could be a rechargeable battery, possibly rechargeable with a USB connection or interface of the system 10. The asset undocked 45 is a first determination by the electronic control 23, with the magnetic-field sensor 24 sensing a disconnection of the magnetic dock 22 from the asset Magnet 32 of the asset Holder 31.

If the magnetic dock 22 is connected to the asset magnet 32, the electronic control 23 enters a sleep state 50 until the asset undocked 45 result is a "YES" 46 response, as shown in FIG. 7. With the asset magnet 32 detached from the magnetic dock, the electronic control 23 enters a user notification 60. The user notification 60 is, for example, a 'chirp' or short-in-duration audible output from the audio transducer 21, for the purpose of informing the user 15 that the asset 34 has been removed, or undocked, from the user holder 11.

After an initial pre-set time period, for example, in the approximate range of five seconds to one minute, the electronic control 23 expects to enter an asset docked 55. After entering the asset docked, the program of the electronic control 23 re-enters the sleep state 50 and waits for the asset undocked 45 to return the YES 46 response with the magnetic-field sensor 24 detecting a disconnection of the magnetic dock 22 from the asset magnet 32 of the asset holder 31.

If instead, the initial pre-set time period passes after the user notification 60, as a default upon failure to enter the asset docked 55 function or state, the electronic control 23 enters an alert delay 65. For example, the alert delay 65 is a different audible signal from the audio transducer 21 that indicates a higher level of urgency as compared to the user notification signal, with the purpose of alert delay to inform the user 15 that the asset 34 has been removed from the user holder 11, for at least the initial pre-set time period.

After a secondary pre-set time period, for example, in the approximate range of one minute to three minutes after the alert delay 65, the electronic control 23 expects to enter the asset docked 55 state. Again, after entering the asset docked 55 function or state, the program of the electronic control 23 re-enters the sleep state 50 and waits for the asset undocked 45 to return the YES 46 response with the magnetic-field sensor 24 sensing a disconnection of the magnetic dock 22 from the asset magnet 32 of the asset holder 31.

If instead, the secondary pre-set time period passes after the user notification 60, as a default upon still failing to enter the asset docked 55 function or state, the electronic control 23 enters an alert 70. The alert 70 function is, for example, a different audio signal that includes a higher level of urgency as compared to the alert delay 65, again from the audio transducer 21. The more urgent audible signal of the alert 70 informs the user 15 that the asset 34 has been removed from the user holder 11 for an extended period of time. In the alert 70 function, and within a terminal, pre-set time period, for example in the approximate range of three minutes to five minutes after the alert 70, the electronic control 23 still expects to enter the asset docked 55. If instead, the terminal pre-set time period passes after the alert delay 65, the electronic control 23 can execute additional functions, as needed to prevent misuse of the asset 34, including activation of a transmitter 27, as shown in FIG. 6, to notify a local intranet or other (e.g., cellular) network, of the extended loss of contact with the asset, so an administrator may take appropriate action. One such action may be locking-out any security clearance or access potentially provided by the asset 34 when the asset is, for example, an ID or access badge.

By intelligently detecting the presence or absence of the asset 34 and alerting the user 15 of the absence of the asset 34, the personal-device detachment sensor apparatus and system 10 helps to eliminate the likelihood that the asset 34 will be misplaced, lost, stolen, or forgotten. Again, the asset can be any ID or access device, such as a card or badge, and the user holder 11 is attached to the user 15 by a lanyard 16 or equivalent acting clip device.

Referring again to FIG. 6, the electronic control 23 can be any suitable programmable or non-programmable circuit, such as a microprocessor, microcontroller, field-programmable gate array (FPGA), unprogrammable (hard-wired) analog or digital circuitry, or a combination of one of more of the aforementioned circuits. Furthermore, the electronic control 23 can include a battery-charger circuit configured to charge the battery 26 via, e.g., inductive charging or via accessible charging contacts (not shown in FIG. 6). Moreover, the transmitter 27 can be any type of transmitter, such as a cell-network transmitter configured to communicate directly with a cell tower or other cell base station, an internet-of-things (IoT) transmitter configured to make the system 10, or at least the user holder 11, part of an IoT network, a wireless transmitter configured to communicate with, for example, a wireless router, or a Bluetooth® or Low-Power Bluetooth® transmitter. The transmitter 27 also can be configured to communicate with, or via, a smart phone carried by the user 15 (FIG. 5). The transmitter 27 can include, or be coupled to, any suitable one or more transmit antennas, or one or more transmitter antenna arrays, which can be located, for example, onboard the user holder 11. Moreover, the user holder 11 can include a receiver configured to receive information from a remote source, such as a cell tower, wireless router, or smart phone. Examples of such information include commands for execution by the electronic control 23, software or firmware for programming the electronic control, and software or firmware updates for the electronic control.

Additional functionality may be added to the user holder 11 to provide additional alerts. For example, a button, or other input or signaling device, may be added to the user holder 11, where if the user were to press and hold the button for one to three seconds, the transmitter 27 would be activated and a distress call could be issued, for example, to a security-monitoring service or to the police via a cellular network, or via the user's smart phone (or other smart phone in range of the transmitter 27).

Referring to FIGS. 1-7, alternate embodiments of the system 10 are contemplated. For example, one or more of the components described as being disposed on the user holder 11 can be disposed on the asset holder 31. Likewise, one or more of the components described as being disposed on the asset holder 31 can be disposed on the user holder 11. Furthermore, the system 10 can incorporate one or more components of, functions of, or steps performed by, the system 80 as described below in conjunction with FIGS. 8A-15, or the system 180 as described below in conjunction with FIG. 16.

Figure 8A:
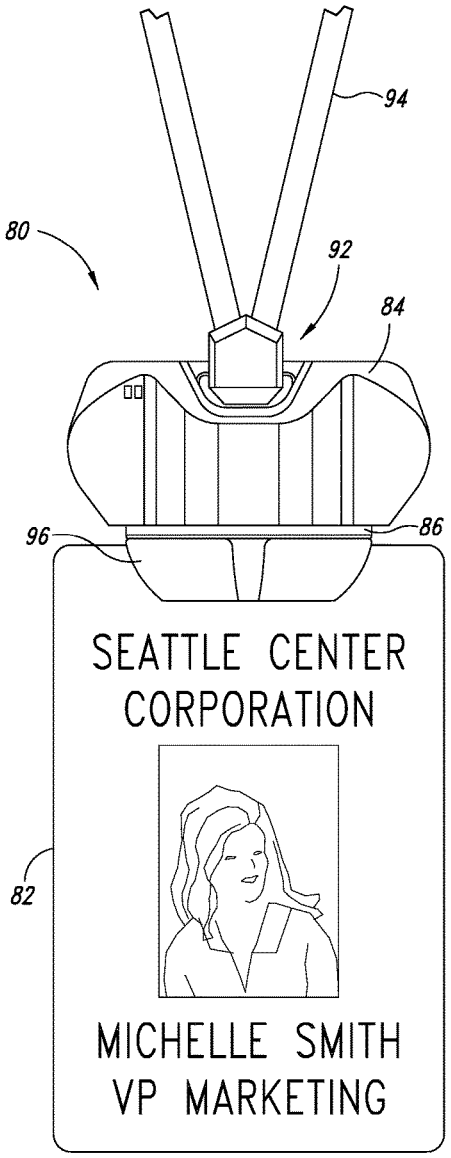
FIG. 8A is an isometric front view of an asset-detachment sensor apparatus and system, with an asset holder of the system attached to a user holder of the system, according to an embodiment.
Figure 8B:
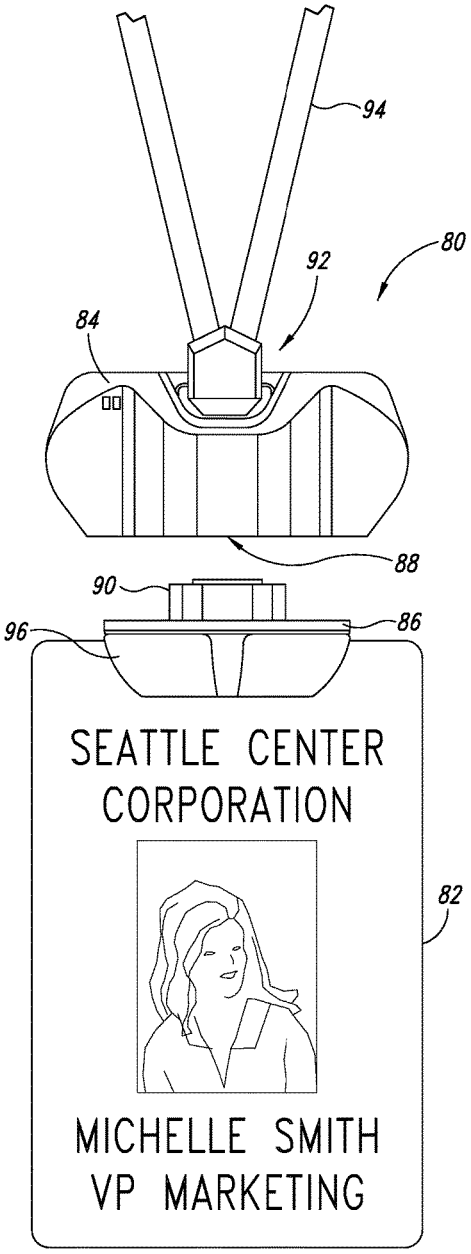
FIG. 8B is an isometric front view of the asset-detachment sensor apparatus and system of FIG. 8A with the asset holder detached from the user holder, according to an embodiment.

FIGS. 8A and 8B are diagrams of a personal-device detachment sensor apparatus and system 80 securing an asset 82, according to an embodiment. The system 80 includes a user holder 84 and an asset holder 86. FIG. 8A is a diagram of the asset holder 86 docketed with, hereinafter attached to, the user holder 84, and FIG. 8B is a diagram of the asset holder undocked, hereinafter detached, from the user holder.

The user holder 84 includes a receptacle, hereinafter a female connector 88, configured to receive a plunger, hereinafter a male connector 90, of the asset holder 86. As described below, the female connector 88 and male connector 90 include respective magnets are, therefore, magnetized. The user holder 84 also includes an attachment structure 92, which is configured for securing the user holder to a user (e.g., a person or other living being) via a lanyard 94 or other attachment mechanism or device. Furthermore, as described below, the user holder 84 includes electronic circuity having an electronic control circuit, a sensor switch for detecting the attachment or detachment of the asset holder 86 from the user holder, and a battery for powering the electronic control circuit and the sensor switch.

In addition to the male connector 90, the asset holder 86 includes a clip 96, or other suitable mechanism or device, for holding the asset 82 (an identification-and-access badge in FIGS. 8A-8B).

Still referring to FIGS. 8A-8B, operation of the system 80 is described, according to an embodiment.

First, a user pulls on the asset holder 86 with a force sufficient to overcome the force of magnetic attraction between the connectors 88 and 90 so as to detach the asset holder from the user holder 84. For example, the user may detach the asset holder 86 from the user holder 84 to swipe the badge 82 through, or over, an access sensor to give the user access (e.g., unlock a door) to a secure area of a building.

The detaching of the asset holder 86 from the user holder 84 transitions the above-described sensor switch from an asset-holder-attached state to an asset-holder-detached state.

In response to detecting the transition of the switch from the asset-holder-attached state to the asset-holder-detached state, the electronic control circuit 102 (FIG. 9) first causes the audio transducer 21 to generate, for example, one or more "chirps to let the user know that the asset holder 86 has been detached, and also to indicate to the user that the battery 26 in the user holder 84 still holds a charge.

Next, the electronic control circuit 102 (FIG. 9) starts measuring an elapsed time starting from the time at which the electronic control circuit detected the state transition. For example, the electronic control circuit can include, or otherwise implement, a counter or timer.

The electronic control circuit 102 (FIG. 9) periodically compares the measured elapsed time to a first threshold length of time, which may be equal to a time deemed sufficient for the user to have used the asset 82 for its intended purpose and to have reattached the asset holder 86 to the user holder 84. For example, the first threshold length of time may be in an approximate range of five seconds to one minute.

If the measured elapsed time equals or exceeds the first threshold before the asset holder 86 is reattached to the user holder 84, then the electronic control circuit 102 (FIG. 9) generates, or causes the generation of, a first alert, such as an audible alarm like a series of "chirps" or "beeps." The purpose of the first alert is to notify the user that the asset holder 86 is not yet reattached to the user holder 84. For example, such failure to reattach the asset holder 86 to the user holder 84 may be due to the user forgetting to reattach the asset holder, or the user being unaware that he/she has dropped the asset holder or has left the asset holder behind.

If after the first alert the asset holder 86 still remains unattached to the user holder 84, then the electronic control circuit continues 102 (FIG. 9) to measure the time elapsed since the electronic control circuit sensed the transition of the state of the sensor switch, and thus sensed the detachment of the asset holder from the user holder.

The electronic control circuit 102 (FIG. 9) periodically compares the measured elapsed time to a second threshold length of time, which is longer than the first threshold length of time and may be equal to a time deemed sufficient for the user to have reattached the asset holder 86 to the user holder 84 regardless of the reasons for the delayed reattachment. For example, the second threshold length of time may be in an approximate range of ten seconds to five minutes.

If the measured elapsed time equals or exceeds the second threshold before the asset holder 86 is reattached to the user holder 84, then the electronic control circuit 102 (FIG. 9) generates, or causes the generation of, a second alert, such as an audible alarm like a siren, which alert is louder, longer, or otherwise more intense than the first alert to indicate that this alert corresponds to a heightened level of urgency as compared to the first alert. Furthermore, the electronic control circuit may transmit a second alert to a remote location, such as a security-monitoring facility. The purpose of the second alert is to notify the user and security personnel that the asset holder 86 is not yet reattached to the user holder 84. For example, such failure to reattach the asset holder 86 to the user holder 84 may be due to another person acquiring the badge 82 without authorization. In response to the second alert, security personnel can deactivate the badge 82, or reconfigure a security system so that it does not "recognize" the badge, to prevent an unauthorized individual from accessing areas for which he/she is not authorized. Furthermore, security personnel can reconfigure the security system to generate a notification if/when one attempts to use the badge for access so that the badge holder can be located and, if appropriate, apprehended.

At some point, the user reattaches the asset holder 86 to the user holder 84; if this reattachment occurs before the elapsed time equals or exceeds the first threshold length of time, then the electronic control circuit 102 generates no alerts. For example, to reattach the asset holder 86 to the user holder 84, the user can guide the male connector 90 of the asset holder toward the female connector 88 of the user holder. When the male connector 90 is close enough (e.g., within approximately 25 millimeters) to the female connector 88, the magnetic attraction between the two connectors facilitates the engagement of the connector 90 into the connector 88. In response to the male connector 90 fully engaging the female connector 88, the sensor switch transitions from the asset-holder-detached state to the asset-holder-attached state.

In response to the reattachment of the asset holder 86 to the user holder 84, the electronic control circuit stops measuring the elapsed time, and may "go to sleep" until the next time that asset holder is detached form the user holder.

Still referring to FIGS. 8A-8B, alternate embodiments of the system 80, and its operation, are contemplated. For example, the user holder 84 can include a male connector, and the asset holder 86 can include a female connector. Moreover, the electronic control circuit may be configured to compare the elapsed time to fewer than or more than two threshold lengths of time, and to generate, or to cause the generation of, fewer than or more than two types of notifications or alerts, respectively, in response to the elapsed time equaling or exceeding one or more of the threshold lengths of time. In addition, the sensor switch can be any suitable type of sensor. Furthermore, the system 80 can include one or more of the operational features described above in conjunction with FIGS. 6-7 for the system 10.

Figure 9:
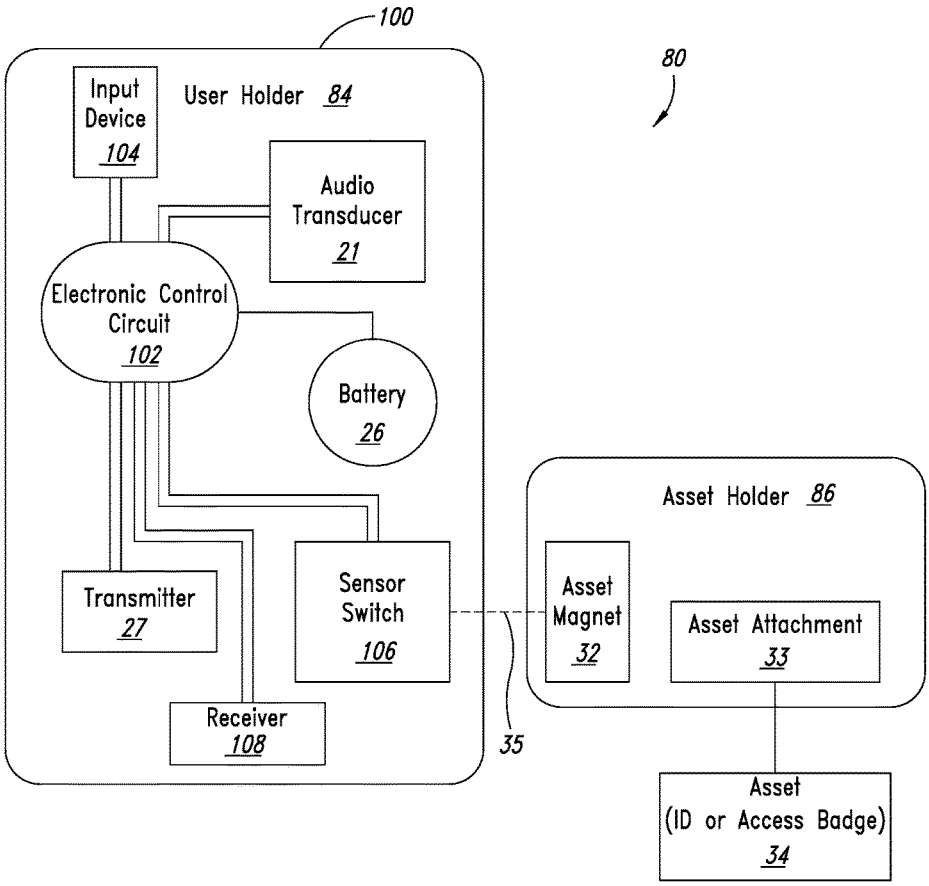
FIG. 9 is a schematic diagram of electronic circuitry of the asset-detachment sensor apparatus and system of FIGS. 8A-8B, according to an embodiment.

FIG. 9 is a schematic diagram of an electronic circuit 100 of the user holder 84, and of the asset holder 86, according to an embodiment, where components common to FIGS. 6 and 9 are labeled with common reference numbers.

The electronic circuit 100 includes the audio transducer 21, the battery 26, the transmitter 27, an electronic control circuit 102, an input device 104, a sensor switch 106, and a receiver 108.

The electronic control circuit 102 is configured to control, and to otherwise communicate with, the audio transducer 21, the battery 26, the transmitter 27, the input device 104, the sensor switch 106, and the receiver 108, and is configured to execute program instructions that cause the electronic control circuit to operate as described above and as otherwise herein. The electronic control circuit 102 can include a memory and other circuitry, and can be, or can include, a microprocessor, microcontroller, FPGA, or hardwired state machine. The electronic control circuit 102 can also include a battery charger configured to charge the battery 26 in response to signals, such as magnetic signals, received from an external charging device (not shown in FIG. 9).

The input device 104 can be a push button, or other device, configured as a "panic button." If a user finds himself/herself in a potentially dangerous, or otherwise dire, situation, he/she can activate the input device 104. In response to the user activating the input device 104, the electronic control circuit 102 is configured to cause the audio transducer 21 to sound an alarm, and to send a distress call, via the transmitter 27, to a security-monitoring firm, the police, or other organization that responds to such distress calls.

The sensor switch 106 is configured to indicate whether the asset holder 86 is attached to the user holder 84. In response to the male connector 90 of the asset holder 86 being fully inserted into the female connector 88 of the user holder 84 (FIGS. 8A and 8B), the switch 106 is configured to have a first state, e.g., an electrically open or "off" state, which state indicates that the asset holder 86 is attached to the user holder 84. Conversely, in response to the male connector 90 not being fully inserted into, or being completely removed from, the female connector 88, the switch 106 is configured to have a second state, e.g., an electrically closed or "on" state, which state indicates that the asset holder 86 is detached from the user holder 84. Because it is anticipated that, during the lifetime of the system 80, the asset holder 86 will be attached to the user holder 84 for much longer than the asset holder will be detached from the user holder, configuring the switch 106 so that the first state is an electrically open or "off" state can reduce the power consumption of the electronic circuit 100, and, therefore, can extend the lifetime of the battery 26. For example, if the electronic circuit 100 lacks the input device 104 (or does not require the input device to be enabled while the asset holder 86 is attached to the user holder 84), then the switch 106 can be coupled in series between the battery 26 and the parallel combination of the other components (e.g., the audio transducer 21, the transmitter 27, the electronic control circuit 104, and the receiver 108) of the electronic circuit such that the electronic circuit draws little or no power from the battery while the asset holder is attached to the user holder. Furthermore, the sensor switch 106 can be, or can include, a mechanical switch, or any other suitable type of switch.

The receiver 108 can be any suitable type of receiver, such as a cellular-network receiver, a LAN (e.g., 802.11 compatible) receiver, a Bluetooth® receiver, or a Low-Power Bluetooth® receiver. For example, the receiver 108 can be configured to receive software, firmware, and software or firmware updates, for the electronic control circuit 102 and for other components of the system 80. The receiver 108 can include, or be coupled to, any suitable one or more receive antennas, or one or more receive antenna arrays, which can be located, for example, onboard the user holder 11. Furthermore, the transmitter 27 and receiver 108 can share one or more antennas or antenna arrays.

Still referring to FIG. 9, alternate embodiments of the electronic circuitry 100 are contemplated. For example, the electronic circuitry 100 can include components in addition to those described, or can omit one or more of the above-described components. Furthermore, the electronic circuitry 100 can include one or more structural and operational features of the electronic circuitry of the user holder 11 as described above in conjunction with FIGS. 6-7.

Figure 10:
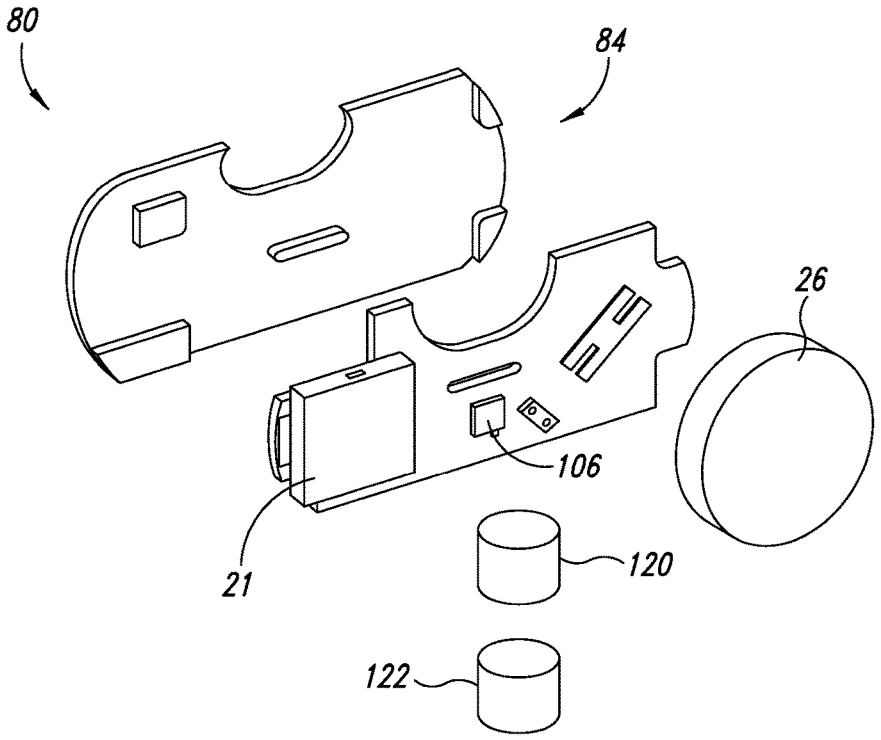
FIG. 10 is an exploded isometric view of parts of the asset-detachment sensor apparatus and system of FIGS. 8A and 8B, according to an embodiment.

FIG. 10 is an exploded partial isometric view of the system 80 of FIGS. 8A-9, according to an embodiment. In addition to the battery 26, the audio transducer 21, and the sensor switch 106, the user holder 84 (FIGS. 8A-8B) includes a first magnet 120, and the asset holder 86 (FIGS. 8A-8B) includes a second magnet 122. The first magnet 120 is disposed at an inner end of the female connector 88 (FIGS. 8A-8B) of the user holder 84, and the second magnet 122 is disposed within the male connector 90 (FIGS. 8A-8B) of the asset holder 86. When within a range of magnetic attraction, for example, of approximately 2.5 mm, the magnets 120 and 122 attract one another, and, therefore, facilitate attachment and reattachment of the asset holder 86 to the user holder 84.

Figure 11:
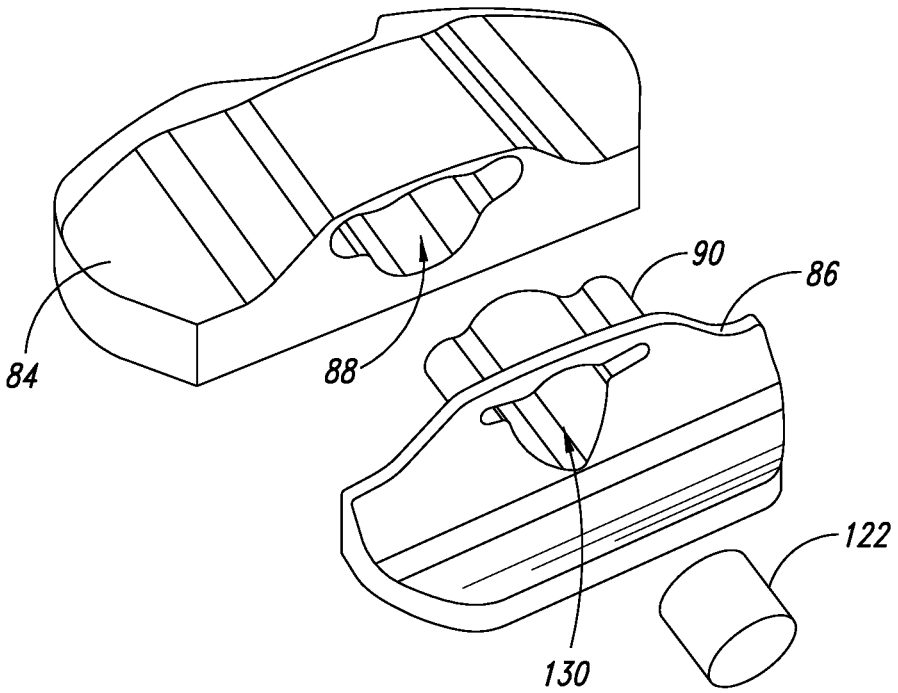
FIG. 11 is an exploded isometric bottom view of the asset-detachment sensor apparatus and system of FIGS. 8A-8B and 10, according to an embodiment.

FIG. 11 is an exploded isometric view of the system 80, according to an embodiment. The male connector 90 of the asset holder 86 includes a cavity 130 configured to receive and to hold the magnet 122, and the male connector and the female connector 88 of the user holder 84 have a peripheral shape (similar to Mickey Mouse® ears in an embodiment) that allows the male connector to fit within the female connector in only a single orientation. The peripheral shape being configured to allow an engagement of the connectors 88 and 90 in only a single orientation prevents inadvertent damage to, and possible improper operation of, the system 80, and helps to ensure that the held asset (e.g., a badge) always has a proper orientation when the asset holder 86 is attached to the user holder 84.

Figure 12:
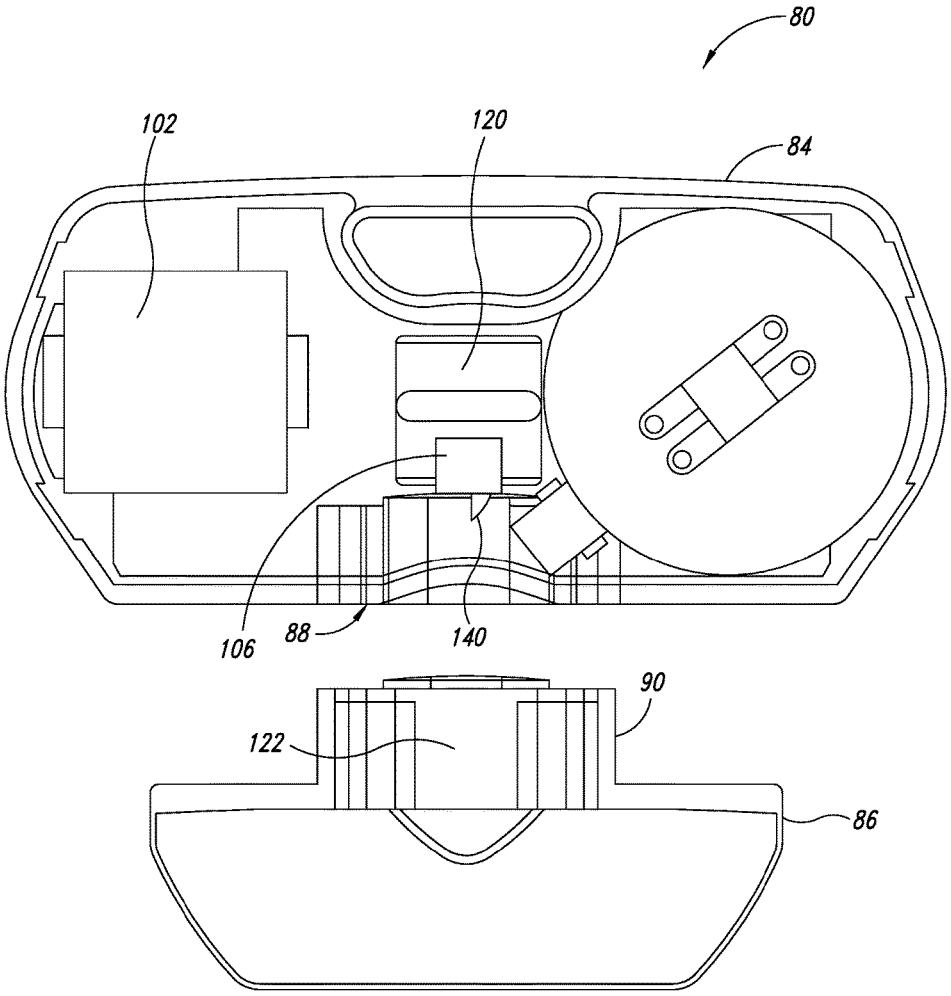
FIG. 12 is an exploded front view with portions broken away of the asset-detachment sensor apparatus and system of FIGS. 8A-8B, 10-11, according to an embodiment.

FIG. 12 is an exploded transparent view of the system 80, according to an embodiment. The sensor switch 106 is disposed behind the magnet 120, and includes a spring-loaded toggle member 140. While the asset holder 86 is detached from the user holder 84, the toggle member 140 has an extended position (the position shown in FIG. 12) that corresponds to the electrically closed or "on" state of the switch 106. And while the asset holder 86 is attached to the user holder 84, a portion of the male connector 90 contacts the toggle member 140, and forces the toggle member to rotate toward the electronic control circuit 102 into a collapsed position that corresponds to the electrically open or "off" state of the switch 106. Therefore, in response to the user removing the asset holder 86 from the user holder 84, the spring action of the toggle member 140 causes the toggle member to move into its extended position, and to thus transition the switch 106 from its "off" state to its "on" state. As discussed above, the electronic control circuit 102 senses this state transition of the switch 106 and, in response to this state transition, determines that the asset member 86 is detached from the user holder 84 and implements one of the routines described above in conjunction with FIGS. 7-8B, or a similar routine.

Still referring to FIG. 12, alternate embodiments are contemplated. For example, the toggle member 140 of the sensor switch 106 can be replaced with a different type of structure such as a spring-loaded push button.

Figure 13:
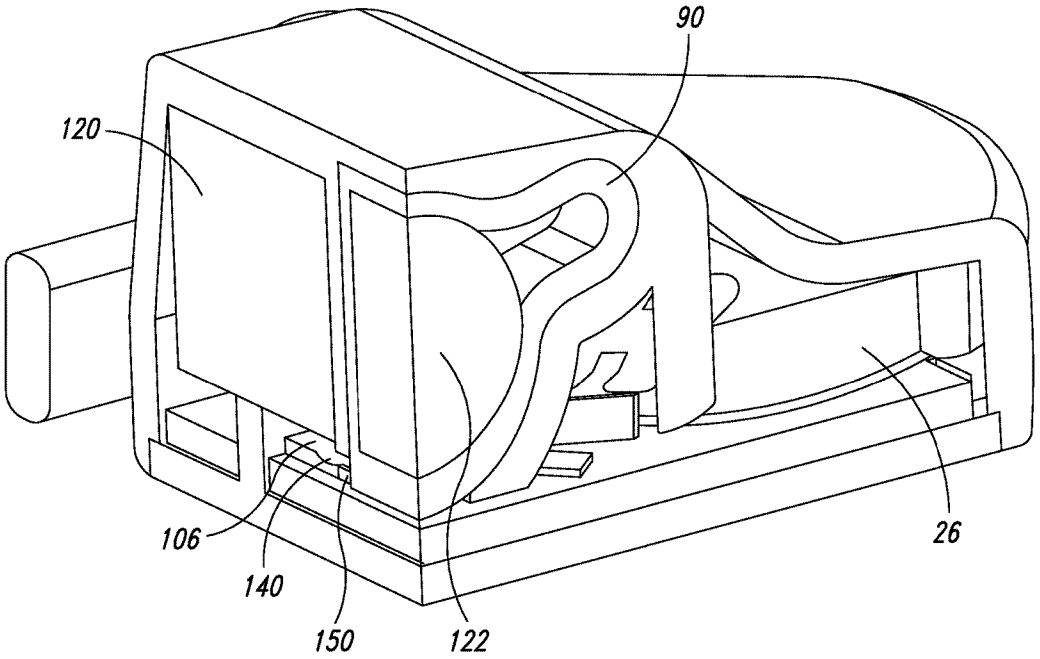
FIG. 13 is an isometric cutaway partial view of the asset-detachment sensor apparatus and system of FIGS. 8A-8B and 10-12, according to an embodiment.

FIG. 13 is a cutaway isometric view of the system 80 while the asset holder 86 is attached to the user holder 84, according to an embodiment. As described above in conjunction with FIG. 12, a portion 150 of the male connector 90 forces the toggle member 140 of the sensor switch 106 into its collapsed position while the asset holder 86 is attached to the user holder 84.

Figure 14:
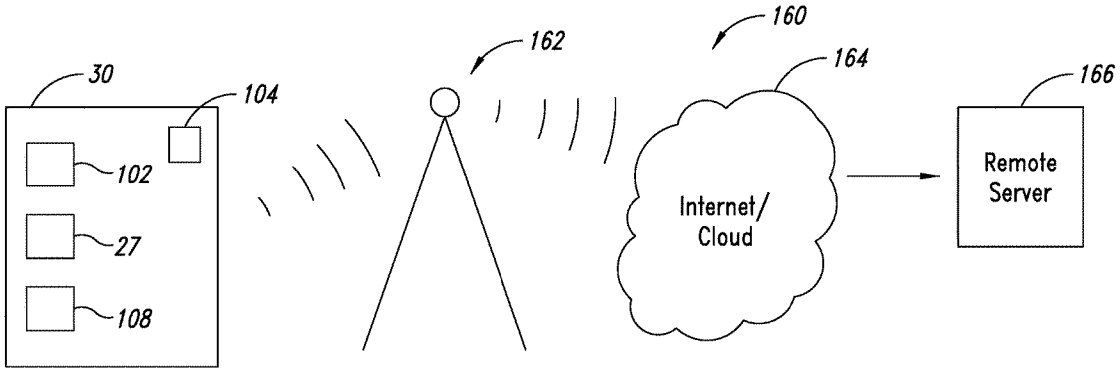
FIG. 14 is a diagram of a network that includes the asset-detachment sensor apparatus and system of FIGS. 8A-8B and 10-13, according to an embodiment.

FIG. 14 is a block diagram of a cellular-based network 160 to which the system 80 belongs, according to an embodiment.

In addition to the system 80, the network 160 includes a cell tower or cell base station 162, the internet (or cloud) 164, and a remote server 166, which can be, for example, a security-monitoring server or a police-department server.

In operation, the electronic control circuit 102 can send, via the transmitter 27, data to the remote server 166 via the cell tower 162 and the internet 164. Examples of the transmitted data include an alert that the asset holder 86 (e.g., FIG. 12) has been detached from the user holder 84 (e.g., FIG. 12) for a length of time that is longer than a threshold time, or can include a distress call initiated by the user activating the input device 104.

Furthermore, the electronic control circuit 102 can receive, via the receiver 108, data from the remote server 166 via the internet 164 and the cell tower 162. Examples of the received data include a software or firmware download or update.

Still referring to FIG. 14, alternate embodiments of the network 160 are contemplated. For example, the network 160 can include components not described, or can omit one or more of the described components. Furthermore, a smart phone can be added to the network 160 as an interface between the system 80 and the cell tower 162. For example, in response to the asset holder 86 being detached from the user holder 84 for a length of time that exceeds a threshold lengthy of time, the electronic control circuit 102 can send an alert to the remote server 166 via the transmitter 27, a smart phone (e.g., the user's smart phone with which the user holder was previously paired), the cell tower 162, and the internet 164. Or, the electronic control circuit 102 can send, to the smart phone via the transmitter 27, a request that the smart phone generate and send an alert to the remote server 166 via the cell tower 162 and the internet 164. In response to the alert, the remote server 166, or other device or person, can, for example, disable access privileges for a badge 82 attached to the asset holder 86. Moreover, the remote server 166 can be configured to determine the physical location of the user holder 84 of the system 80; the ability to determine the physical location of the user holder can be particularly useful if a user activates the input device 104 to send a distress call. For example, the electronic circuitry 100 of the user holder 84 can be configured to determine its own location using onboard GPS circuitry, and to send its location to the remote server 166. Or, the remoter server 166 can be configured to approximate the location of the user holder 84 from location information provided by the cell tower 162, or may even be able to triangulate the location of the user holder if the user holder can communicate with at least three cell towers. In addition, the remote server 166 can query a database instantiated on the remote server, or instantiated elsewhere, to determine a time and/or a location of the badge 82 at its last use or attempted use. Moreover, the asset holder 86 (e.g., FIG. 12) can include electronic circuitry configured to communicate with the remote server 166, for example, to send an alert that it is detached from the user holder 84 or to provide a location of the detached asset holder (in this latter case, the asset holder's electronic circuitry may include GPS circuitry, or the remote server can be configured to approximate the location of the asset holder in a manner similar to the manner described above in which the remote server may approximate the location of the user holder).

Figure 15:
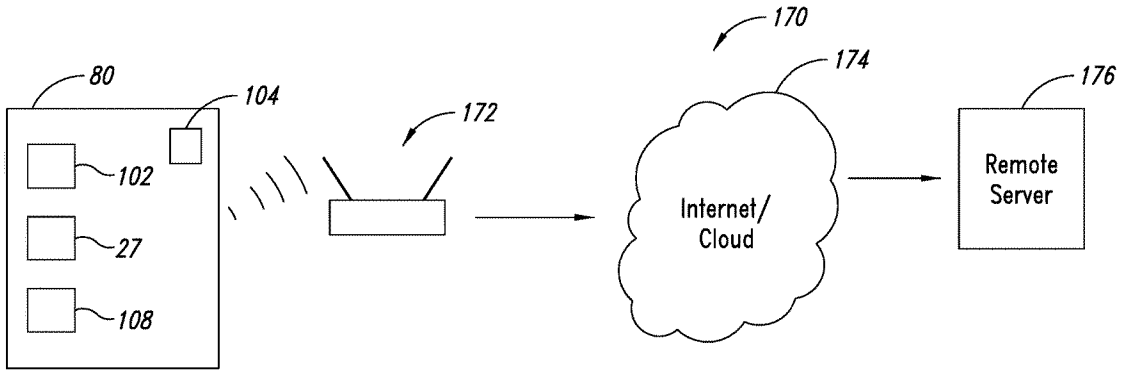
FIG. 15 is a diagram of a network that includes the asset-detachment sensor apparatus and system of FIGS. 8A-8B and 10-13, according to another embodiment.

FIG. 15 is a block diagram of a local-area-based network 170 to which the system 80 belongs, according to an embodiment.

In addition to the system 80, the network 170 includes a wireless router/modem 172, the internet (or cloud) 174, and a remote server 176, which can be, for example, a security-monitoring server or a police-department server.

In operation, the electronic control circuit 102 can send, via the transmitter 27, data to the remote location 176 via the router/modem 172 and the internet 164. Examples of the transmitted data include an alert that the asset holder 86 (e.g., FIG. 12) has been detached from the user holder 84 (e.g., FIG. 12) for a length of time that is longer than a threshold time, or can include a distress call initiated by the user activating the input device 104.

Furthermore, the electronic control circuit 102 can receive, via the receiver 108, data from the remote location 176 via internet 174 and the router/modem 172. Examples of the received data include a software or firmware download or update.

Still referring to FIG. 15, alternate embodiments of the network 170 are contemplated. For example, the network 170 can include components not described, or can omit one or more of the described components. Furthermore, a smart phone can be added to the network 170 as an interface between the system 80 and the router/modem 172. For example, in response to the asset holder 86 being detached from the user holder 84 for a length of time that exceeds a threshold lengthy of time, the electronic control circuit 102 can send an alert to the remote server 176 via the transmitter 27, a smart phone (e.g., the user's smart phone with which the user holder was previously paired), the router/modem 172, and the internet 174. Or, the electronic control circuit 102 can send, to the smart phone via the transmitter 27, a request that the smart phone generate and send an alert to the remote server 176 via the router/modem 172 and the internet 174. In response to the alert, the remote server 176, or other device or person, can, for example, disable access privileges for a badge 82 attached to the asset holder 86. Moreover, the remote server 176 can be configured to determine the physical location of the user holder 84 of the system 80; the ability to determine the physical location of the user holder can be particularly useful if a user activates the input device 104 to send a distress call. For example, the electronic circuitry 100 of the user holder 84 can be configured to determine its own location using onboard GPS circuitry, and to send its location to the remote server 176, or the electronic circuitry can be configured to communicate with the user's, or another's, smartphone via the transmitter 27 and use the smartphone's onboard GPS circuitry to determine or approximate the location of the user holder. Or, the remoter server 176 can be configured to approximate the location of the user holder 84 from location information provided by the modem/router 172. In addition, the asset holder 86 (e.g., FIG. 12) can include electronic circuitry configured to communicate with the remote server 176, for example, to send an alert that it is detached from the user holder 84 or to provide a location of the detached asset holder (in this latter case, the asset holder's electronic circuitry may include GPS circuitry, or the remote server can be configured to approximate the location of the asset holder in a manner similar to the manner described above in which the remote server may approximate the location of the user holder).

Referring to FIGS. 8A-15, alternate embodiments of the system 80 are contemplated. For example, the system 80 can incorporate one or more components of, functions of, or steps performed by, the system 10 as described above in conjunction with FIGS. 1-7, or the system 180 as described below in conjunction with FIG. 16.

Figure 16:
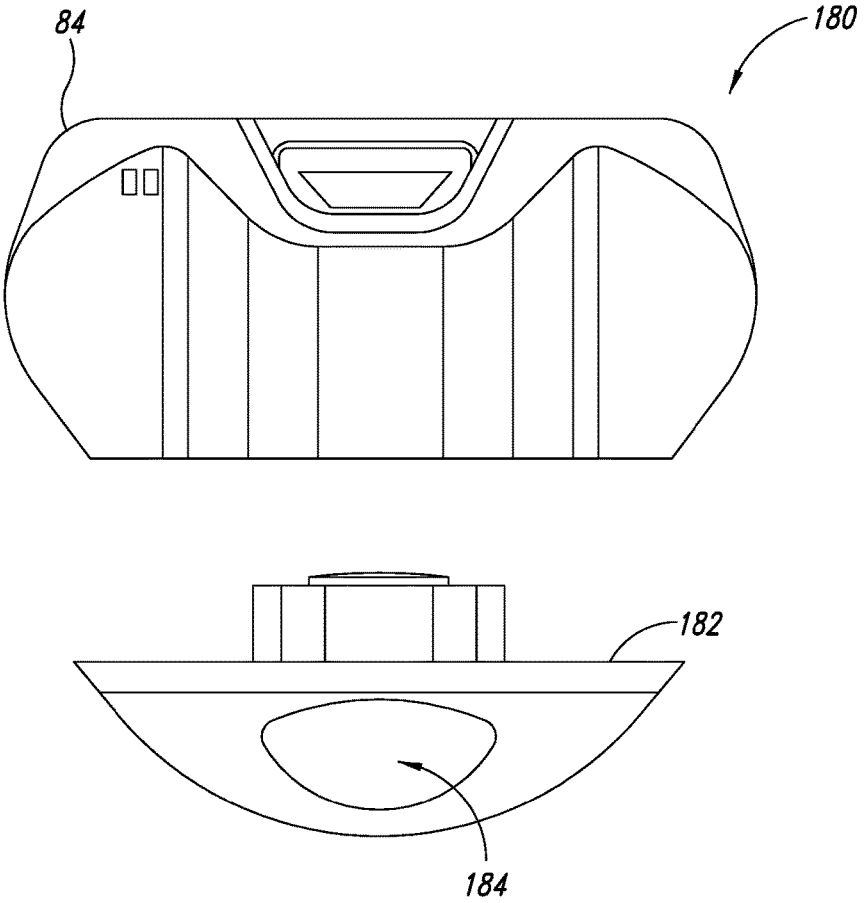
FIG. 16 is an exploded isometric view of an asset-detachment sensor apparatus and system, according to another embodiment.

FIG. 16 is an exploded view of a personal-device detachment sensor apparatus and system 180, according to an embodiment. The system 180 includes the user holder 84 and an asset holder 182, which can be similar in structure and operation to the asset holder 86 of FIGS. 8A-15 except that the asset holder 182 includes an opening 184 configured to hold an asset such as one or more keys (not shown in FIG. 16). Referring to FIGS. 8A-8B and 16, the user holder 84 can be configured to be compatible with different types of asset holders, such as the asset holders 86 and 182, so that a user can swap out asset holders with the same user holder depending on the asset that the user wants to secure to the asset holder.

Referring to FIG. 16, alternate embodiments of the system 180 are contemplated. For example, the system 180 can incorporate one or more components of, functions of, or steps performed by, the system 10 as described above in conjunction with FIGS. 1-7, or the system 80 as described above in conjunction with FIGS. 8A-15.

In compliance with the statutes, one or more embodiments have been described in language more or less specific as to structural features and process steps. Furthermore, the specification illustrates embodiments with the understanding that the present disclosure is to be considered an exemplification of the principles of one or more embodiments, and the disclosure is not intended to limit the disclosure to the particular embodiments described. Those with ordinary skill in the art will appreciate that other embodiments and variations are possible, which employ the same or similar concepts as described above. Therefore, the invention is not to be limited except by the following claims, as appropriately interpreted.

Of note, the terms "substantially," "proximate to" and "approximately" are employed herein throughout, including this detailed description and the attached claims, with the understanding that is denotes a level of exactitude or equivalence in amount or location commensurate with the skill and precision typical for the particular field of endeavor, as applicable. For example, when describing a quantity, such a physical length or length of time, these terms can indicate a range of values of the quantity within ±10% of the given value of the quantity. As an example, "approximately ten seconds" would indicate a range of time within 10±1 seconds.

The invention claimed is:

1. A user holder, comprising:

a first connector configured to engage a second connector of an asset holder;

a notifier; and an electronic control circuit coupled to the notifier and configured to determine whether the second connector of the asset holder has been disengaged from the first connector for at least a first threshold length of time, to cause the notifier to generate a first alert in response to determining that the second connector has been disengaged from the first connector for at least the first threshold length of time, to determine whether the second connector of the asset holder has been disengaged from the first connector for at least a second threshold length of time that is longer than the first threshold length of time, and to cause the notifier to generate a second alert that is different from the first alert in response to determining that the second connector has been disengaged from the first connector for at least the second threshold length of time.

2. The user holder of claim 1 wherein one of the first and second connectors fits into the other of the first and second connectors.

3. The user holder of claim 1 wherein at least one of the first connector and second connector includes a magnet.

4. The user holder of claim 1 wherein the notifier includes an audio transducer.

5. The user holder of claim 1 wherein the electronic control circuit includes a microprocessor or microcontroller.

6. The user holder of claim 1, further comprising a switch configured:

to have a first state in response to the second connector of the asset holder being engaged with the first connector; and to have a second state in response to the second connector of the asset holder being disengaged from the first connector.

7. The user holder of claim 1 wherein the switch includes an electromechanical switch.

8. The user holder of claim 1 wherein the switch includes a Hall effect sensor.

9. The user holder of claim 1, further comprising:

a transmitter coupled to the electronic control circuit; and wherein the electronic control circuit is configured to send, via the transmitter, a notification to a remote location in response to determining that the second connector has been disengaged from the first connector for at least the first threshold length of time.

10. The user holder of claim 1, further comprising:

an input device configured to be activated by a living being; and wherein the electronic circuit is configured to activate the notifier in response to a living being activating the input device.

11. The user holder of claim 1, further comprising:

a transmitter;

an input device configured to be activated by a living being; and wherein the electronic circuit is configured to send, via the transmitter, a notification to a remote location in response to a living being activating the input device.

12. The user holder of claim 1 wherein the first threshold length of time is as short as approximately zero seconds.

13. The user holder of claim 1 wherein causing the notifier to generate the second alert includes causing the notifier to notify a security system.

14. A system, comprising:

an asset holder configured to hold an asset;

a user holder configured to engage the asset holder; and wherein at least one of the asset holder and the user holder is configured to determine whether the asset holder has been disengaged from the user holder for at least a first threshold length of time, to generate a first notification in response to determining that the asset holder has been disengaged from the user holder for at least the first threshold length of time, to determine whether the asset holder has been disengaged from the user holder for at least a second threshold length of time that is longer than the first threshold length of time, and to generate a second notification that is different from the first notification in response to determining that the asset holder has been disengaged from the user holder for at least the second threshold length of time.

15. The system of claim 14, wherein the user holder is configured for attachment to a user.

16. The system of claim 14 wherein:

the asset holder includes a first connector having a first permanent magnet; and the user holder includes a second connector having a second permanent magnet and configured to engage the first connector such that the first and second permanent magnets attract one another.

17. The system of claim 14 wherein:

the asset holder includes a first connector; and the user holder includes a second connector configured to engage, magnetically, the first connector.

18. The system of claim 14 wherein:

the asset holder includes a first connector;

the user holder includes a second connector configured to engage the first connector; and at least one of the first connector and the second connector includes a magnetic material.

19. The system of claim 14, further comprising:

a transmitter; and an electronic control circuit coupled to the transmitter and configured to send, via the transmitter, the second notification to a remote location.

20. The system of claim 19, further comprising:

GPS circuitry configured to determine a location of at least one of the asset holder and the user holder; and wherein the at least one of the asset holder and the user holder is configured to include, in the second notification, an indication of the location of the at least one of the asset holder and the user holder.

21. A method, comprising:

detecting a detachment of an asset holder from a user holder by detecting a transition of a switch from a first state to a second state;

measuring a time that has elapsed since the detecting of the detachment;

determining if the measured time exceeds a threshold;

generating a notification in response to determining that the measured time exceeds the threshold; and allowing an increase in a power consumption of at least one of the asset holder and the user holder while the switch has the second state as compared to a power consumption while the switch has the first state.

22. The method of claim 21 wherein generating the notification includes notifying a security system.

23. A method, comprising:

detecting a detachment of an asset holder from a user holder;

measuring a time that has elapsed since the detecting of the detachment;

determining if the measured time exceeds a first threshold;

generating a first notification in response to determining that the measured time exceeds the first threshold;

determining determining if the measured time exceeds a second threshold; and generating a second notification that is different from the first notification in response to determining that the measured time exceeds the second threshold.

24. The method of claim 23, wherein generating the first notification includes notifying a remote location in response to determining that the measured time exceeds the first threshold.

25. The method of claim 24, further comprising:

determining a location of at least one of the asset holder and the user holder; and wherein notifying the remote location includes sending, to the remote location, information related to the location.

26. The method of claim 23, further comprising notifying a security system in response to determining that the measured time exceeds the second threshold.

* * * * *